US010837269B2

(12) United States Patent
Feng et al.

(10) Patent No.: US 10,837,269 B2
(45) Date of Patent: Nov. 17, 2020

(54) MULTI-STAGE FRACTURING SLIDING SLEEVE

(71) Applicants: Yongcun Feng, Austin, TX (US); Yangtze University, Hubei (CN); China University of Petroleum-Beijing, Beijing (CN)

(72) Inventors: Yongcun Feng, Austin, TX (US); Fucheng Deng, Hubei (CN); Jingen Deng, Beijing (CN)

(73) Assignees: Yongcun Feng (CN); Yangtze University (CN); China University of Petroleum-Beijing (CN)

( * ) Notice: Subject to any disclaimer, the term of this patent is extended or adjusted under 35 U.S.C. 154(b) by 198 days.

(21) Appl. No.: 16/013,994

(22) Filed: Jun. 21, 2018

(65) Prior Publication Data

US 2019/0383117 A1 Dec. 19, 2019

(30) Foreign Application Priority Data

Jun. 15, 2018 (CN) ..... 2018 1 0618056

(51) Int. Cl.

| | |
|---|---|
| ***E21B 43/26*** | (2006.01) |
| ***E21B 34/14*** | (2006.01) |
| ***E21B 34/10*** | (2006.01) |

(52) U.S. Cl.

CPC ..... *E21B 43/26* (2013.01); *E21B 34/103* (2013.01); *E21B 34/142* (2020.05); *E21B 2200/06* (2020.05)

(58) Field of Classification Search

CPC ..... E21B 34/14; E21B 2034/007

See application file for complete search history.

(56) References Cited

U.S. PATENT DOCUMENTS 9,574,414 B2 * 2/2017 Arabsky ..... E21B 34/14

* cited by examiner

*Primary Examiner* — Robert E Fuller

(57) ABSTRACT

A multi-stage fracturing sliding sleeve is provided, which comprises a fracturing pipe, a shear slip device, a fracturing sleeve, a ball seat support, a first sliding sleeve and a limiting sleeve, the fracturing sleeve seals fracturing ports, the ball seat support and the fracturing pipe are connected through at least one first shear pin, a first spring is arranged between the first sliding sleeve and the limiting sleeve, a second sliding sleeve is arranged below a multi-segment ball seat and connected with the first sliding sleeve, an outer wall of the first sliding sleeve comprises a downward facing annular shoulder, an inner wall of the limiting ring comprises an upward facing annular shoulder, the first spring is located between the downward facing annular shoulder and the upward facing annular shoulder, and an upper end face of the limiting ring limits the axial travel of the first sliding sleeve.

16 Claims, 7 Drawing Sheets

MULTI-STAGE FRACTURING SLIDING SLEEVE

This application claims priority to Chinese Patent Application No. 201810618056.1 filed on Jun. 15, 2018, the disclosure of which is hereby incorporated in its entirety by reference.

FIELD

The present invention relates to the field of underground construction equipment in the process of secondary development of old wells in oil gas fields and non-conventional energy development, especially a multi-stage fracturing sliding sleeve.

BACKGROUND

In order to further exploit the production capacity of producing wells in oil gas fields, improve the production efficiency of shale gas producing wells or geothermal development wells and maintain the yield, parts of the wells need to be, for example, fractured within the production cycle of the producing wells. Since producing formations are buried in strata ranging from hundreds to thousands of meters in depth and divided into a plurality of bed series, there are inevitable differences among the formations influenced by various factors, To maximize the potential of each formation, each single formation needs to be treated as far as possible. The previous staging method is mainly of a ball seat support type, namely that the inner diameter of the ball seat support becomes smaller and smaller from top to bottom. This seriously restricts the increase of the stage number of acid fracturing and the improvement of scale.

The technical solution of the prior art is that: in terms of the segmented stage number of staged fracturing abroad, 0.125 in (3.175 mm) is generally the first stage, with the minimum inner diameter of 1.25 in (31.75 mm). If oil pipes with the specification of 2 7/8 in×5.5 mm are used, the maximum arrangement can only be 52.5 mm (the ball is 0.25 in (i.e., 6.35 mm) larger than the ball seat support), that is to say, only 6.5 stages can be arranged within the oil pipes with the specification of 2 7/8 in×5.5 mm, and the maximum arrangement is 7 stages.

An unlimited-stage sliding sleeve and a technological method are recorded in the Chinese patent document CN 105089601 A, which solve the technical problem, by a sealing displacement mechanism of split claws, and thee inner diameters of flow passages are kept in consistency, but not at the expense of the inner diameters. Multi-stage fracturing can be realized in theory. But the structure is relatively complex, and the use reliability is difficult to guarantee.

Further, the demand for geothermal or underground temperature regulation of high temperature oil and gas reservoirs and dry hot rocks in the prior art also puts forward higher requirements for fracturing construction, for example, we hope to achieve fracturing construction for many times in one fracturing section, but there is no relatively mature solution in the prior art. For another example, higher fracturing pressure is needed in the prior art, if 60 MPa is to be reached, clearances which are difficult to seal exist between the dropped plug and the ball seat support, such as clearances between the split claws along the circumference, and these clearances make it more difficult to increase the pressure. Therefore, a fracturing sliding sleeve capable of precisely controlling and realizing opening for many times provided that the inner pipe bore diameter is guaranteed needs to be designed to ensure that the fracturing process is carried out.

SUMMARY

The technical problem to be solved in the invention is to provide a multi-stage fracturing sliding sleeve which can realize multi-stage sleeve connection, the structure is compact and concise, and the sliding sleeve is convenient to operate. In a preferred solution, fracturing construction for many times can be realized in one fracturing section, and the pressure for fracturing construction can be improved.

In order to solve the above technical problem, the technical solution used in the invention is; a multi-stage fracturing sliding sleeve, which comprises joint members, a fracturing pipe and a shear slip device.

A fracturing sleeve, a ball seat support, a first sliding sleeve and a limiting sleeve are arranged from top to bottom along a fracturing pipe, a downward facing shoulder of the fracturing sleeve engaging an upward facing shoulder of the ball seat support, all of the fracturing sleeve, the ball seat support and the first sliding sleeve, are in sliding connection with the fracturing pipe, wherein the fracturing sleeve seals a plurality of fracturing ports in the fracturing pipe in an initial state; the ball seat support and the fracturing pipe are connected through at least one first shear pin; a first spring is arranged between the first sliding sleeve and the limiting sleeve; the limiting sleeve limits the axial position of the first sliding sleeve.

A slidable multi-segment ball seat are arranged in the ball seat support which is fit to the slidable multi-segment ball seat through an inclined plane, when the slidable multi-segment ball seat slides down, the diameter passing through the section, between the slidable multi-segment ball seat increases.

A second sliding sleeve is arranged below the -slidable multi-segment ball seat and connected with the first sliding sleeve in a sliding mode; the second sliding sleeve and the first sliding sleeve are connected through the shear dogs.

In the preferred solution, the total shear force of the shear dogs is greater than that of the first shear pin.

In the preferred solution, a third spring is arranged between the shear dogs and the second sliding sleeve so that the shear dogs are biased radially outward to be connected with the first sliding sleeve.

In the preferred solution, a plurality of shear dog holes connected with the shear dogs are formed in the first sliding sleeve and divided into a plurality of groups which, are distributed in a staggered mode in the axial direction of the first sliding sleeve.

A second spring is arranged between the second sliding sleeve and the first sliding sleeve.

In the preferred solution, the staggering distance between several groups of shear dog holes is smaller than the travel for the fracturing sleeve to open the fracturing boles in a sliding mode.

In the preferred solution, the fracturing sleeve is connected with the ball seat support, and a first seal sleeve is arranged between the fracturing sleeve and the fracturing pipe at the upstream of the fracturing holes.

In the preferred solution, a cylindrical seat is arranged at an upper end Thee of the ball seat support, and the cylindrical seat and the outer wall of the dropped plug form a seal structure.

In the preferred solution, the pitching ball is a sphere or a block with reducing curved surfaces at both ends and a cylindrical section in the middle.

In the preferred solution, a one-stage bench is arranged at the outer wall of the first sliding sleeve, a one stage bench is arranged at the inner wall of the limiting sleeve, the first spring is located between the two;benches, and the upper end face of the limiting sleeve and the bench of the first sliding sleeve from an axial limiting structure.

In the preferred solution, a flange is formed at the top of the second sliding sleeve, and shear dogs are movably installed in the flange.

A two-stage bench is arranged at the inner wall of the first sliding sleeve, an axial limiting structure is formed between an upper bench and the annular structure, and a lower bench is used to install the second spring.

The invention provides a multi-stage fracturing sliding sleeve. By using the shear structure, the structure of the fracturing sliding sleeve in the prior art is greatly simplified, and multi-stage fracturing construction can be realized without reducing the inner diameter. In the preferred solution, the provision of the shear dog holes distributed in a staggered mode enables re-connection and re-shearing of the shear dogs at different heights to realize fracturing construction for many times after the, second sliding sleeve, is reset. The structure of the cylindrical seat is provided in such a way that a seal structure is directly formed between the ball seat support and the dropped plug, so that the sealing requirement for the clearances between the circumferences of the slidable multi-segment ball seat is greatly reduced.

BRIEF DESCRIPTION OF THE DRAWINGS

The multi-stage fracturing sliding sleeve is further illustrated below in combination with the figures and embodiments.

Figure 1:
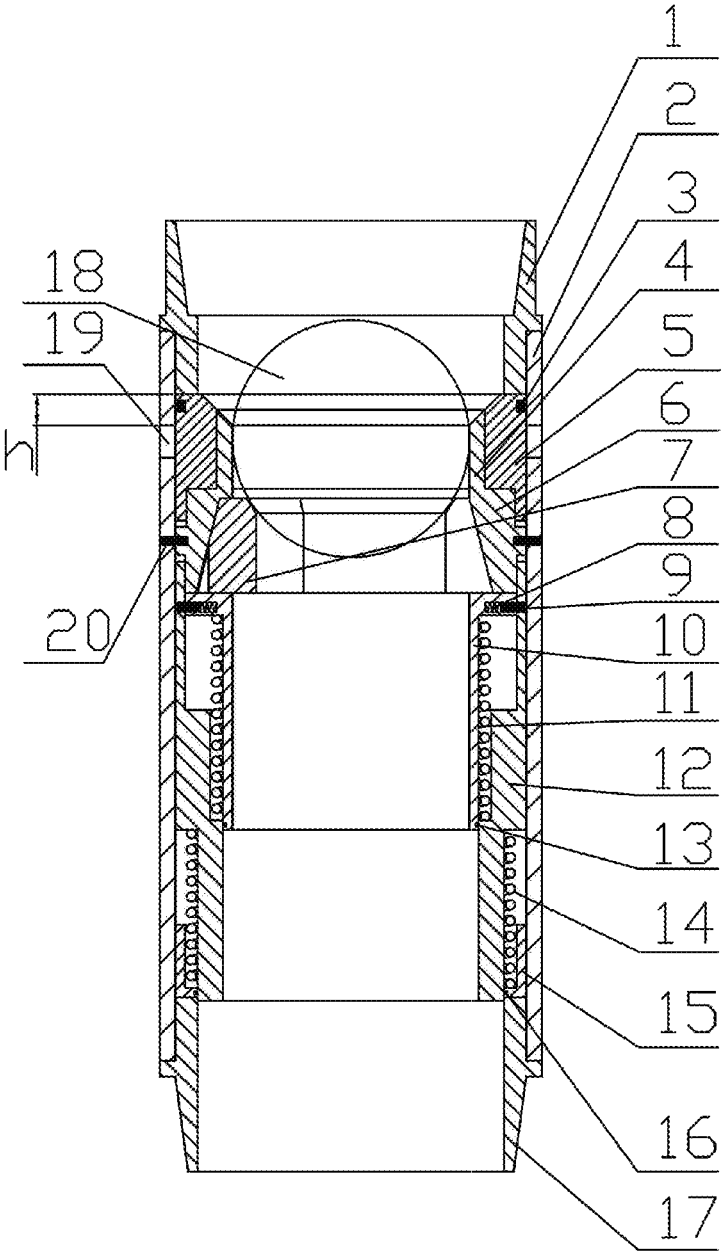
FIG. 1 is a diagram of the section structure of the multi-stage fracturing sliding sleeve.

In the figures: upper joint 1, fracturing pipe 2 first seal sleeve 3, cylindrical seat 4, fracturing sleeve 5, ball seat support 6, multi-segment ball seat 7, third spring 8, second shear pins (shear dogs) 9, second sliding sleeve 10, second spring 11, first sliding sleeve 12, second seal sleeve 13, first spring 14, limiting sleeve 15, third seal sleeve 16, lower joint 17, dropped plug 18, fracturing holes 19, second shear pm holes 21.

DETAILED DESCRIPTION

Embodiment 1:

As shown in FIG. 1, a multi-stage fracturing sliding sleeve, which comprises joint members, such as the upper joint 1, the lower joint 17, the fracturing pipe 2 and the shear slip device in FIG. 1; fracturing holes 19 distributed along the circumference are formed in the outer wall of the fracturing pipe 2.

The fracturing sleeve 5, ball seat support 6, first sliding 12 and limiting 15 are arranged from top to bottom along the fracturing pipe 2, forming the one-stage shear gliding device; all of the fracturing 5, the ball seat support 6 and the first sliding sleeve 12 are in sliding connection with the fracturing pipe 2; the fracturing sleeve 5, the ball seat support 6 and the first sliding sleeve 12 are fixedly connected. Preferably, the connection between the fracturing sleeve 5 and the ball seat support 6 is threaded or interference fit, and the connection between the ball seat support 6 and the first sliding sleeve 12 is threaded or interference fit, wherein the fracturing sleeve 5 forms plugging by sealing the fracturing holes 19 in the fracturing pipe 2 in a. natural state; in a working state, the fracturing pipe 2 opens the fracturing holes 19 influenced by a hydraulic, medium on the thrust of the dropped plug 18. The ball seat support 6 and the fracturing pipe 2 are connected through at least one first shear pin 20. A first spring 14 is arranged between the first sliding sleeve 12 and the limiting sleeve 15, and the limiting sleeve 15 limits the axial position of the first sliding sleeve 12.

Figure 6:
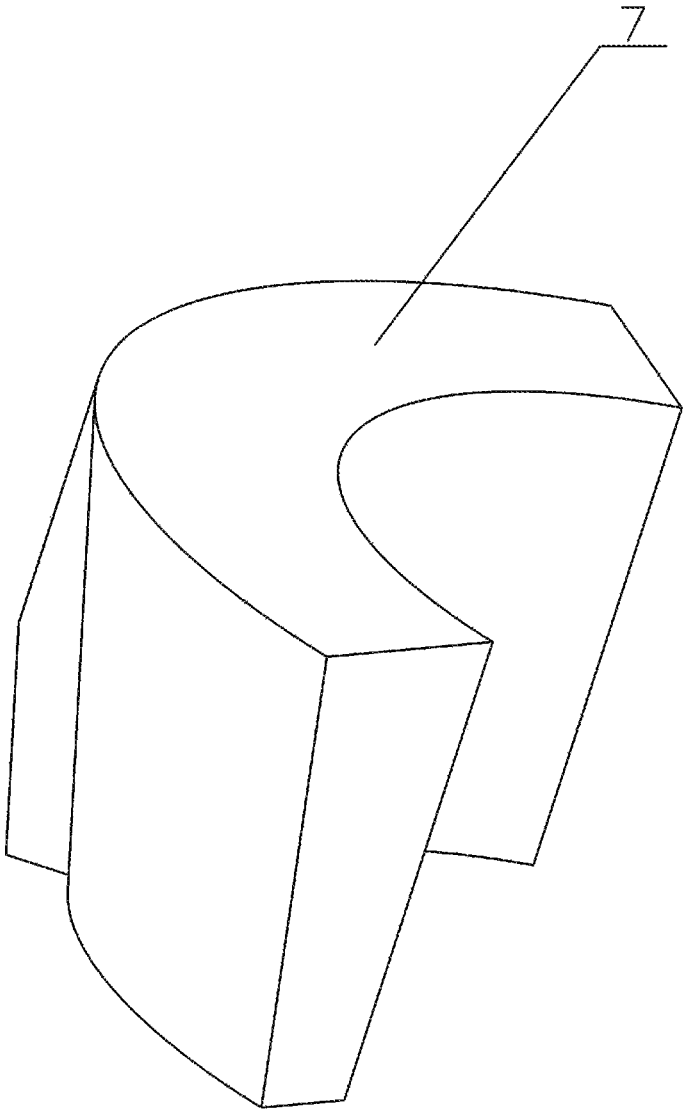
FIG. 6 is a three-dimensional diagram of one segment of the multi-segment ball seat in the multi-stage fracturing sliding sleeve.
Figure 7:
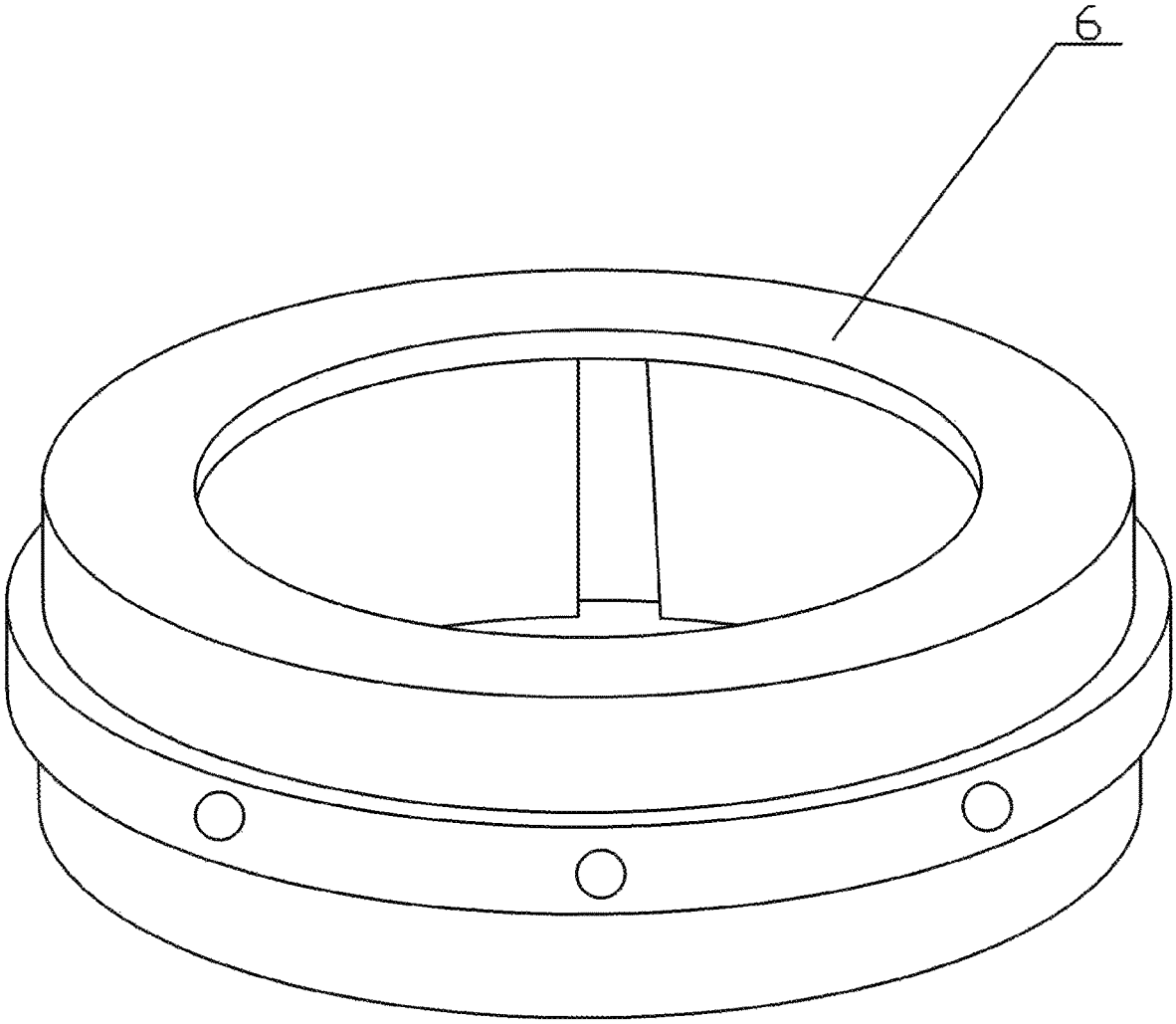
FIG.7 is a three-dimensional diagram of the ball seat support in the multi-stage fracturing sliding sleeve.

As shown in FIGs. 1, 6 and 7, slidable multi-segment ball seat 7 are arranged in the ball seat support 6 which is fit to the multi-segment ball seat 7 through an inclined plane. In this case, the multi-segment ball seat 7 are in a three-segment structure, and the three-segment multi-segment ball seat 7 form a circular ring as a whole. Bosses are formed at the back of the multi-segment ball seat 7, chutes are formed on the inner wall of the ball seat support 6, and the bosses slide in the chutes to have the effect of limiting. An inner inclined plane is formed on the inner wall of the ball seat support 6, and an outer inclined plane is formed on the outer wall of multi-segment ball seat 7. When the multi-segment ball seat 7 slides down, the multi-segment structure between the multi-segment ball seat 7 is radially unfolded, and the diameter passing through the section between the multi-segment ball seat 7 increases so that the dropped plug 18 can pass through the next stage of fracturing sliding sleeve.

The second sliding sleeve 10 is arranged below the multi-segment ball seat 7, the second sliding sleeve 10 limits the axial position of the multi-segment ball seat 7, the second sliding sleeve 10 is in sliding connection with the first sliding sleeve 12. and the second seal sleeve is arranged between the second sliding ring sleeve 10 and the first sliding sleeve 12. The second sliding sleeve 10 and the first sliding sleeve 12 are connected through the second shear pins (shear dogs) 9. In the preferred solution, the total shear force of the shear dogs 9 is greater than that of the first shear pin 20. With this structure, after descending to the well, put the dropped plug 18 into the position of the ball seat support 6 so that the dropped plug 18 is limited by the multi-segment ball seat 7, continue to input the pressure medium, the pressure value at this time is the first pressure, for example, 5-10 MPa, the first pressure acting on the dropped plug 18 is enough to shear the first shear pin 20 off, the ball seat support 6 drives the fracturing sleeve 5 and the first sliding sleeve 12 to go down, first shear pin 20 is sheared off, and the first spring 14 is compressed so that. the fracturing holes 19 are opened to realize the fracturing construction of the hydrocarbon reservoir. When the fracturing construction is completed, continue to input the pressure medium, the pressure value at this time is the second pressure, for example, 15-20 MPa, the dropped plug 18 drives the multi-segment ball seat 7 to go down, and the second spring 11 is compressed. The multi-segment ball seat 7 expands the through-hole diameter in the process of going down until it is enough for the dropped plug 18 to pass through. When the dropping plug 18 passes through the multi-segment ball seat 7, the fracturing sleeve 5, the ball seat support 6, the multi-segment bail seat 7, the second sliding sleeve 10 and the first sliding sleeve 12 are reset under the action of the second spring 11 and the first spring 14, and the fracturing holes 19 on this section are re-plugged.

Figure 3:
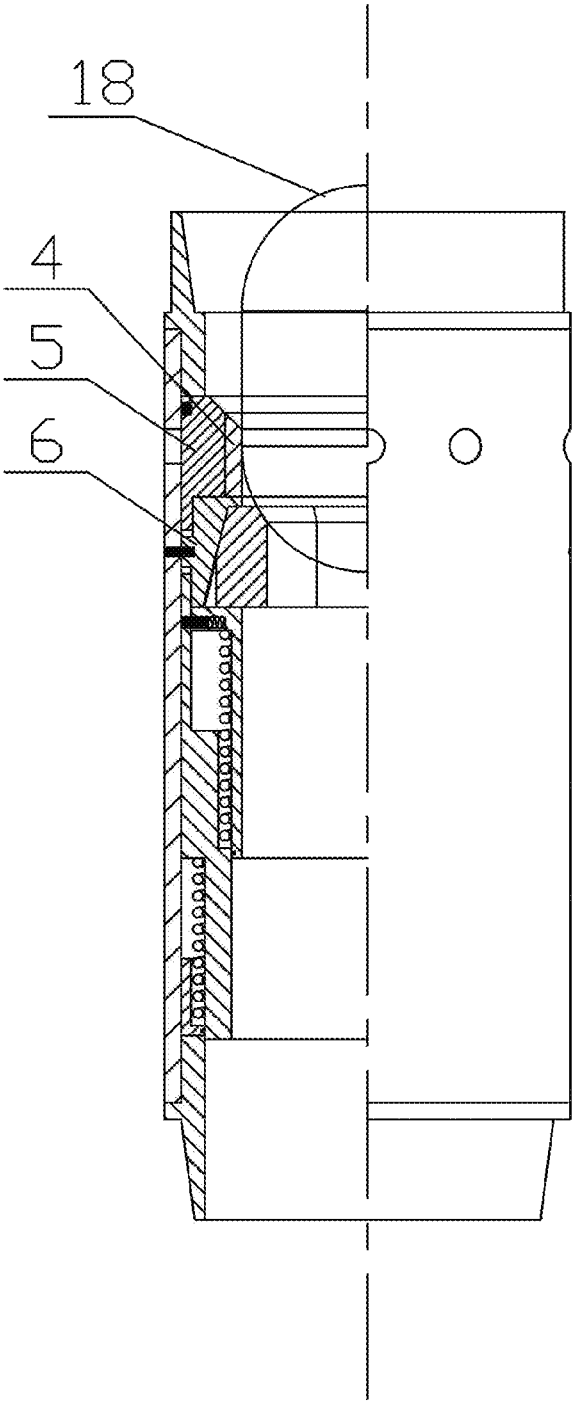
FIG. 3 is a diagram of the semi-section structure of the multi-stage fracturing sliding sleeve.
Figure 4:
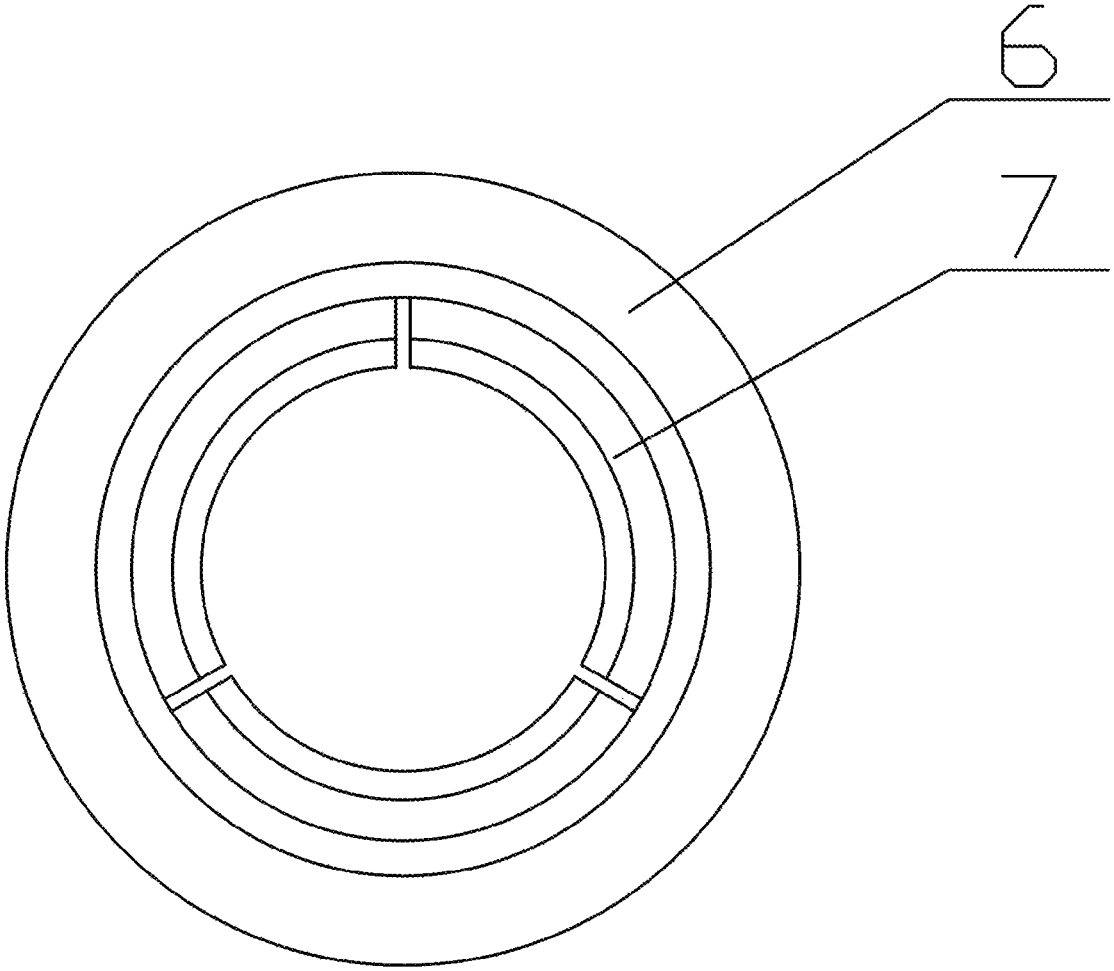
FIG. 4 is a top view of the ball seat support and the multi-segment ball seat in the multi-stage fracturing sliding sleeve.
Figure 5:
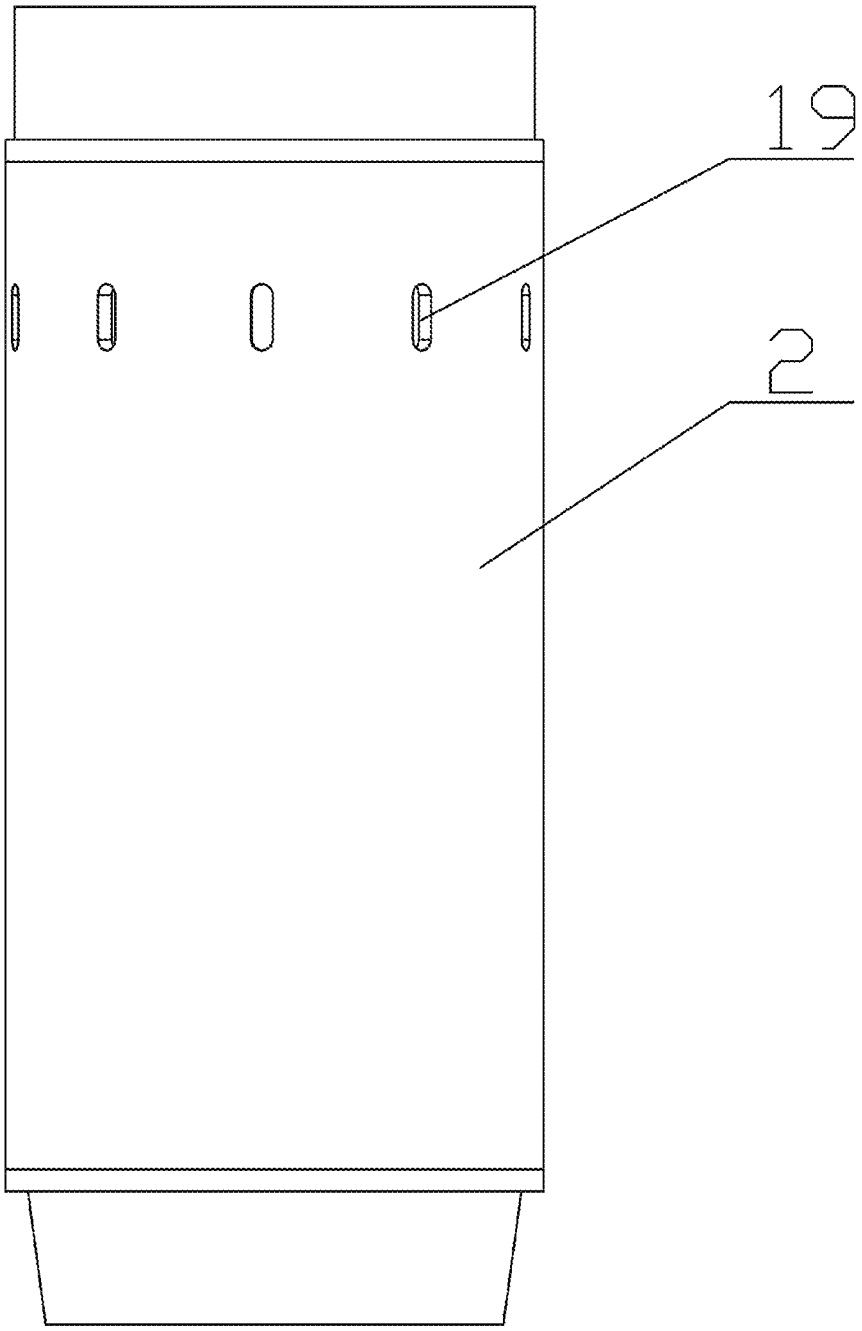
FIG. 5 is a main view of the multi-stage fracturing sliding sleeve.

Embodiment 2:

On the basis of embodiment 1, in the preferred solution, as in FIGs. 1 and 3, a third spring 8 is arranged between the shear dogs 9 and the second sliding sleeve 10 so that the shear dogs 9 are biased radially outward to be connected with the first sliding sleeve 12. With this structure, the shear dogs 9 can be connected with the first sliding sleeve 12 again so it is easy to shear off again to realize secondary fracturing operation.

Figure 2:
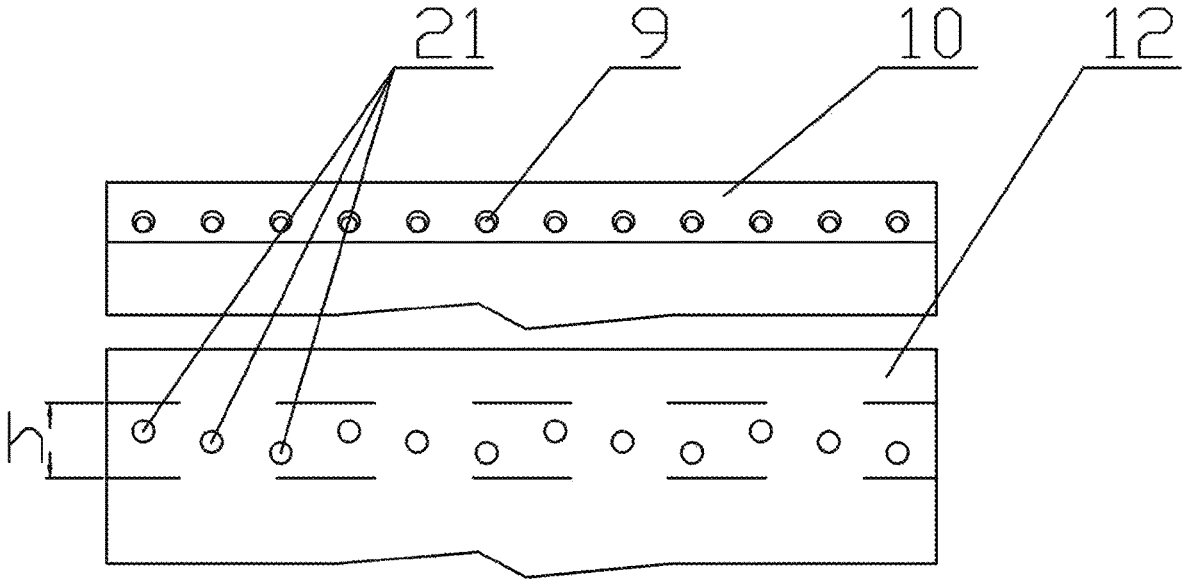
FIG. 2 is a structure diagram of the outer wall of the second sliding sleeve and the inner wall of the first sliding sleeve which are unfolded along the circumference.

Embodiment 3:

On the basis of embodiment 1 or 2, in the further preferred solution, as in FIG. 2, a plurality of shear dog holes 21 connected with the shear dogs 9 are formed in the first sliding sleeve 12, the shear dog holes 21 are divided into a plurality of groups which are distributed in a staggered mode in the axial direction of the first sliding sleeve 12, and the second spring 11 is arranged between the second sliding sleeve 10 and the first sliding sleeve 12. With this structure, the shear dogs 9 and the shear dog holes 21 between different groups are connected with each other, thus achieving more reliable re-fracturing operation. In this case, a group of shear dogs 9 at the bottom are interconnected with the shear dog holes 21 and a group of shear dogs pins 9 at upper level are connected with the shear dog holes 21 after resetting, until the a group of shear dogs 9 at the top are connected. A combination of this case and embodiment 2 enables fracturing construction for many times, preferably 2-3 times.

In the preferred solution, as in FIGs. 1 and 2, the staggering distance between several groups of shear dog holes 21 is smaller than the travel for the fracturing sleeve 5 to open the fracturing holes 19 in a sliding mode, for example, h its FIGs. 1 and 2.

Embodiment 4:

On the basis of embodiments 1-3, in the preferred solution, the, fracturing sleeve 5 is connected with the ball seat support 6, and the first seal sleeve 3 is arranged between the fracturing sleeve 5 and the fracturing pipe 2 at the upstream of the fracturing holes 19, In the preferred solution, the cylindrical seat 4 is arranged at the upper end face of the ball seat support 6, and a seal structure is directly formed by the cylindrical seat 4 and the outer wall of the dropped plug 18. With this structure, the requirement for sealing between the multi-segment ball seat 7 is reduced, so that a pressure medium with greater pressure can be withstood. In the alternative solution, an integrated structure is formed between the cylindrical seat 4 and the ball seat support 6, and processing and installation are facilitated with this structure, as shown in FIG. 1. In another alternative solution, a split structure is formed between the cylindrical seat 4 and the ball seat support 6, the cylindrical seat 4 and the fracturing sleeve 5 are fixedly connected by threaded or interference fit, and the fracturing sleeve S and the ball seat support 6 are fixedly connected by threaded or interference fit. With this structure, it is easy to make the cylindrical seat 4 using a softer material such as copper or copper alloy to improve the sealing effect.

In the preferred solution, the pitching ball 18 is, a sphere, as shown in FIG. 1, or a block with reducing curved surfaces at both ends and a cylindrical section in the middle, as shown in FIG. 3. With this structure, better sealing between the pitching ball 18 and the cylindrical seat 4 can be realized.

In the preferred solution, the one-stage bench is arranged at the outer wall of the first sliding sleeve 12, the one-stage bench is arranged at the inner wall of the limiting sleeve 15, the first spring 14 is located between the two benches, and the upper end face of the limiting sleeve 15 and the bench of the first sliding sleeve 12 form the axial limiting structure.

In the preferred solution, the flange is formed at the top of the second sliding sleeve 10, and the shear dogs 9 are movably installed in the flange.

The two-stage bench is arranged at the inner wall of the first sliding sleeve 12, an axial limiting structure is formed between the upper bench and the annular structure, and the lower bench is used to install the second spring 11.

After descending to the well, put the dropped plug 18 into the position of the ball seat support 6 and form sealing with the cylindrical seat 4, so that the dropped plug 18 is limited by the multi-segment ball seat 7, continue to input the pressure medium, the pressure value at this time is the first pressure, for example, 5-10 MPa, the first pressure acting on the dropped plug 18 is enough to shear the first shear pin 20 off, the ball seat support 6 drives the fracturing sleeve 5 and the first sliding sleeve 12 to go down, the first shear pin 20 is sheared off, and the first spring 14 is compressed so that the fracturing holes 19 are opened to realize the fracturing construction of the hydrocarbon reservoir. When the fracturing construction is completed, continue to input the pressure medium, the pressure value at this time is the second pressure, for example, 15-20 MPa, the dropped plug 18 drives the multi-segment ball seat 7 to go down, and the second spring 11 is compressed. The multi-segment ball seat 7 expand the through-hole diameter in the process of going down until it is enough for the dropped plug 18 to pass through. When the dropped plug 18 passes through the multi-segment ball seat 7, the fracturing sleeve 5, the ball seat support 6, the multi-segment ball seat 7, the second sliding sleeve 10 and the first sliding sleeve 12 are reset under the action of the second spring 11 and the first spring 14, and the fracturing holes 19 on this section are re-plugged. Since the shear dog holes 21 on the first sliding sleeve 12 are arranged in a staggered mode, another group of shear dogs 9 and the shear dog holes 21 are connected with each other during resetting to wait for the next fracturing construction.

The above embodiments are only preferred technical solutions of the present invention, and they should not be construed as to limit the present invention in any way. The embodiments in this application and the features in the embodiments can be combined with each other arbitrarily without conflict. The scope of protection of the invention shall take the technical solution recorded in the claim, including the equivalent alternative solution of the technical features in the technical solution recorded in the claim, as the scope of protection. That is to say, the equivalent alternative improvement within this scope is also within the scope of protection of the invention.

What is claimed is:

1. A multi-stage fracturing sliding sleeve, comprising a fracturing pipe and a shear slip device, wherein a fracturing sleeve, a ball seat support, a first sliding sleeve and a limiting sleeve are arranged from vertically along the fracturing pipe, a downward facing shoulder of the fracturing sleeve engaging an upward facing shoulder of the ball seat support; all of the fracturing sleeve, the ball seat support and the first sliding sleeve are in sliding connection with the fracturing pipe, wherein the fracturing sleeve seals a plurality of fracturing ports in the fracturing pipe in an initial state; the ball seat support and the fracturing pipe are connected through at least one first shear pin; a first spring is arranged between the first sliding sleeve and the limiting sleeve; the limiting sleeve limits an axial position of the first sliding sleeve;

a slidable multi-segment ball seat is arranged in the ball seat support which mates with the slidable multi-segment ball seat along a surface inclined with respect to a longitudinal axis of the fracturing pipe, when the slidable multi-segment ball seat slides down, an inner diameter of the multi-segment ball seat increases;

a second sliding sleeve is arranged below the slidabie multi-segment ball seat and is connected with the first sliding sleeve in a sliding mode; the second sliding sleeve and the first sliding sleeve are connected through shear dogs, an outer wall of the first sliding sleeve comprises a downward facing annular shoulder, an inner wall of the limiting ring comprises an upward facing annular shoulder, the first spring is located between the downward facing annular shoulder and the upward facing annular shoulder, and an upper end face of the limiting ring limits the axial travel of the first sliding sleeve.

2. The multi-stage fracturing sliding sleeve according to claim 1, wherein, a third spring is arranged between the shear dogs and the second sliding sleeve so that the shear dogs are biased radially outward to be connected with the first sliding sleeve, and a total shear force of the shear dogs is greater than that of the first shear pins.

3. The multi-stage fracturing sliding sleeve according to claim 2, wherein, a plurality of shear dog holes connected with the shear dogs are formed in the first sliding sleeve and divided into a plurality of groups which are distributed in a staggered mode, in the axial direction of the first sliding sleeve;

a second spring is arranged between the second sliding sleeve and the first sliding sleeve.

4. The multi-stage fracturing sliding sleeve according to claim 3, wherein, a staggering distance between several groups of shear dog holes is smaller than the travel for the fracturing sleeve to open the fracturing holes in a sliding mode.

5. The multi-stage fracturing sliding sleeve according to claim 4 wherein, a cylindrical seat is arranged at an upper end face of the ball seat support; the cylindrical seat and an outer wall of a dropped plug form a sealed interface.

6. The multi-stage fracturing sliding sleeve according to claim 5, wherein, the dropped plug is a sphere or a block with reducing curved surfaces at both ends and a cylindrical section in the middle.

7. The multi-stage fracturing sliding sleeve according to claim 2, wherein, a cylindrical seat is arranged at an upper end face of the ball seat support; the cylindrical seat and an outer wall of a dropped plug form a sealed interface.

8. The multi-stage fracturing sliding sleeve according claim 3, wherein, a cylindrical seat is arranged at an upper end face orf the ball seat suppot; the cylindrical seat and an outer wall of a dropped plug form a sealed interface.

9. The multi-stage fracturing sliding sleeve according to claim 8, wherein, the dropped plug is a sphere or a block with reducing curved surfaces at both, ends and a cylindrical section in the middle.

10. The multi-stage fracturing sliding sleeve according to claim 1, wherein, a third spring is arranged between the shear dogs and the second sliding sleeve so that the shear dogs are biased radially outward to be connected with the first sliding sleeve.

11. The multi-stage fracturing sliding sleeve according to claim 10, wherein, a cylindrical seat is arranged at an upper end face of the ball seat support; the cylindrical seat and an outer wall of a dropped plug form a sealed interface.

12. The multi-stage fracturing sliding sleeve according to claim 1, wherein, a first seal sleeve is arranged between the fracturing sleeve and the fracturing pipe at an upstream side of the fracturing holes.

13. The multi-stage fracturing sliding sleeve according: to claim 12, wherein, a cylindrical seat is arranged at an upper end face of the hall seat support; the cylindrical seat and an outer wall of a dropped plug form a sealed interface.

14. The multi-stage fracturing sliding sleeve according to claim 13, wherein, the dropped plug is a sphere or a block with reducing curved surfaces at both ends and a cylindrical section in the middle.

15. The multi-stage fracturing sliding sleeve according to claim 1, wherein, a cylindrical seat is arranged at an upper end face of the ball seat support; the cylindrical seat and an outer wall of a dropped plug form a sealed interface.

16. The multi-stage fracturing sliding sleeve according to claim 1, wherein, a flange is formed at the top of the second sliding sleeve, and the shear dogs are movably installed in the flange;

an inner wall of the first sliding sleeve comprises upper and lower upward facing annular shoulders, the upper annular shoulder limiting downward travel of the flange, and the lower, annular shoulder abutting the second spring.

* * * * *